US012663154B1

(12) United States Patent
Binek et al.

(10) Patent No.: US 12,663,154 B1
(45) Date of Patent: Jun. 23, 2026

(54) ORBITAL COMBUSTOR FUEL SUPPORT ARCHITECTURE

(71) Applicant: RTX Corporation, Farmington, CT (US)

(72) Inventors: Lawrence Binek, Glastonbury, CT (US); Timothy Snyder, Glastonbury, CT (US); Frederick Rosenberger, West Hartford, CT (US)

(73) Assignee: RTX Corporation, Farmington, CT (US)

( * ) Notice: Subject to any disclaimer, the term of this patent is extended or adjusted under 35 U.S.C. 154(b) by 10 days.

(21) Appl. No.: 19/213,677

(22) Filed: May 20, 2025

(51) Int. Cl.

| | |
|---|---|
| ***F23R 3/28*** | (2006.01) |
| ***F23R 3/00*** | (2006.01) |
| ***F23R 3/60*** | (2006.01) |
| *F23R 3/04* | (2006.01) |
| *F23R 3/06* | (2006.01) |

(52) U.S. Cl.
CPC ..... *F23R 3/283* (2013.01); *F23R 3/002* (2013.01); *F23R 3/60* (2013.01); *F23R 3/045* (2013.01); *F23R 3/06* (2013.01); *F23R 2900/00017* (2013.01)

(58) Field of Classification Search
None
See application file for complete search history.

(56) References Cited

U.S. PATENT DOCUMENTS

| | | | | |
|---|---|---|---|---|
| 5,277,022 | A * | 1/1994 | Shekleton | F23R 3/32 60/737 |
| 7,093,445 | B2 | 8/2006 | Corr et al. | |
| 12,066,188 | B2 | 8/2024 | Binek et al. | |
| 12,072,101 | B2 | 8/2024 | Binek et al. | |
| 2013/0104553 | A1 | 5/2013 | Stoia et al. | |
| 2013/0174558 | A1 * | 7/2013 | Stryapunin | F23R 3/002 60/734 |
| 2022/0307694 | A1 * | 9/2022 | Binek | F23R 3/346 |

* cited by examiner

*Primary Examiner* — Lorne E Meade
*Assistant Examiner* — Alyson Joan Harrington
(74) *Attorney, Agent, or Firm* — Kinney & Lange, P.A.

(57) ABSTRACT

A combustor system for an aerial vehicle includes an outer liner with a first end and a second end, an inner combustor case contained within the outer liner and defining a central combustor chamber, a lumen extending into the central combustor chamber, an air flow path extending between the outer liner and the inner combustor case, an integrated air scoop attached to the inner combustor case at the lumen and directing air from the air flow path into the central combustor chamber, and a fuel bolt, the fuel bolt including a head located outside of the outer liner and a body starting outside of the outer liner and extending perpendicular to the outer liner through the outer liner, through the integrated fuel scoop, and ending at the lumen, and fuel manifold with a fuel orifice within the fuel bolt.

18 Claims, 2 Drawing Sheets

ORBITAL COMBUSTOR FUEL SUPPORT ARCHITECTURE

BACKGROUND

A combustor section in a modern turbine engine includes one or more fuel injectors. Each fuel injector is operable to inject fuel for combustion within a combustion chamber. Air is mixed with fuel to facilitate combustion. Various types and configurations of fuel injectors and air flow paths are known in the art. While these known fuel injectors and air flow paths have various benefits, there is still room in the art for improvement. There is a need in the art, for example, more robust ways to attach inner and outer combustor cases.

SUMMARY

One example of a combustor system for an aerial vehicle includes an outer liner with a first end and a second end, an inner combustor case contained within the outer liner and defining a central combustor chamber, a lumen extending into the central combustor chamber, an air flow path extending between the outer liner and the inner combustor case, an integrated air scoop attached to the inner combustor case at the lumen and directing air from the air flow path into the central combustor chamber, and a fuel bolt, the fuel bolt including a head located outside of the outer liner and a body starting outside of the outer liner and extending perpendicular to the outer liner through the outer liner, through the integrated fuel scoop, and ending at the lumen, and fuel manifold with a fuel orifice within the fuel bolt.

Another example of a combustor system for an aerial vehicle includes an outer liner, the outer liner having a first end and a second end, an inner combustor case contained within the outer liner, the inner combustor case defining an outer periphery of a central combustor chamber, the inner combustor case having a plurality of lumens extending through the inner combustor case into the central combustor chamber, a first air flow path extending between and defined by the outer liner and the inner combustor case, and fluidly connected to the central combustor chamber by the plurality of lumens, a plurality of integrated air scoops, each respective integrated air scoop attached to the inner combustor case at each respective lumen and configured to direct air from the first air flow path into the central combustor chamber, a plurality of fuel bolts, the plurality of fuel bolts including a plurality of heads located outside of the outer liner and a plurality of bodies starting outside of the outer liner and extending perpendicular to the outer liner through the outer liner, through the plurality of integrated fuel scoops, and ending at the plurality of lumens, and a plurality of fuel manifolds with a plurality of fuel orifices within each respective fuel bolt.

An example method of forming an assembly for a gas turbine engine including forming an annular outer liner, the annular outer liner having a central axis, forming an annular inner case concentric with and radially inward of the annular outer liner, forming a fuel bolt, the fuel bolt comprising a head, a body, a threaded portion, and a fuel manifold with a fuel orifice extending radially along the body of the fuel bolt, forming an air scoop connected to the annular inner case, the air scoop comprising a scoop boss with threads, forming a radially extending bore through the annular outer liner, the air scoop, and the inner casing, and positioning the fuel bolt through the radially extending bore and securing the fuel bolt to the air scoop via the threads of the fuel bolt and the threads of the scoop boss.

The present summary is provided only by way of example, and not limitation. Other aspects of the present disclosure will be appreciated in view of the entirety of the present disclosure, including the entire text, claims, and accompanying figures.

Figure 1:
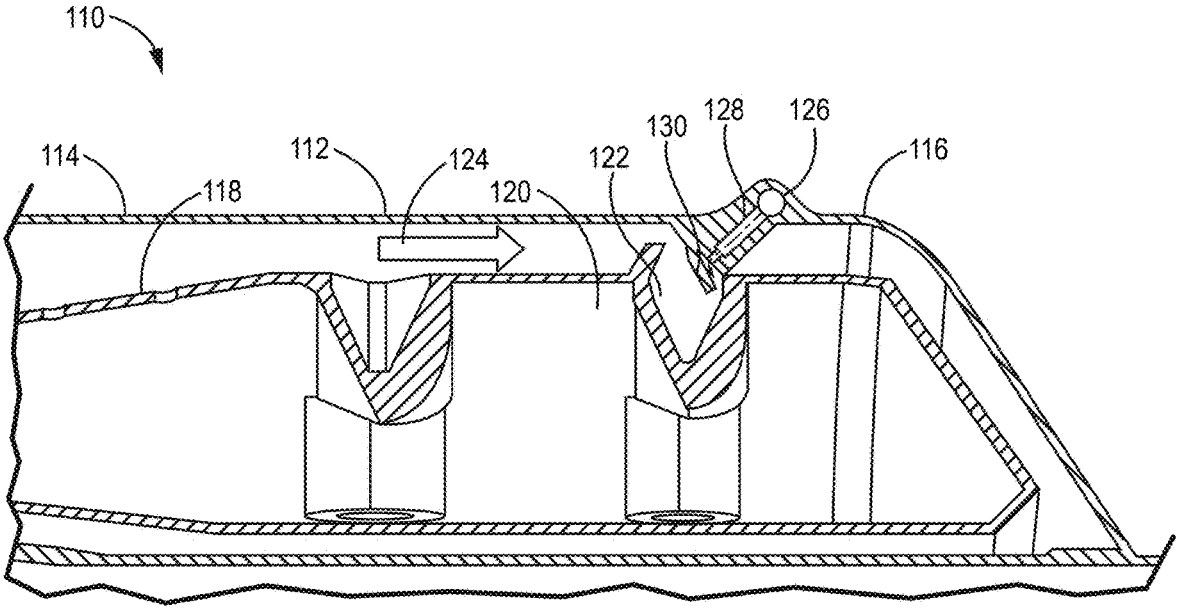
FIG. 1 (PRIOR ART)
FIG. 1 is a schematic side sectional illustration of a conventional prior art combustor for an aerial vehicle.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

This disclosure presents a combustor system for a gas turbine engine. In particular, this disclosure involves directing a fluid containing oxygen into a central combustor chamber via an airflow path that includes an air scoop.

FIG. 1 is a side sectional illustration of a conventional gas turbine engine combustor assembly 110 within an engine (not more broadly pictured). This engine can be located within an aerial vehicle such as, but not limited to, an unmanned aerial vehicle (UAV), a drone, or any other manned or unmanned aircraft or self-propelled projectile. This turbine engine is configured for propelling the aerial vehicle during flight.

Assembly 110 includes outer liner 112 with first end 114 and second end 116, inner combustor case 118 defining central combustor chamber 120 with lumen 122, first air flow path 124, fuel manifold 126, fuel orifice 128, and splash plate 130.

In current combustor assemblies as shown in FIG. 1, outer liner 112 has first end 114 and second end 116. Outer liner 112 surrounds inner combustor case 118. Inner combustor case defines central combustor chamber 120, with lumen 122 connecting inner combustor chamber 120 to first air flow path 124. Air flow path 124 extends between outer liner 112 and inner combustor case 118. Air flows from first end 114 of outer liner 112 towards second end 116 before being directed through into central combustor chamber 120 through lumen 122. Fuel manifold 126 is part of outer liner 112 and directs fuel from manifold 126 through fuel orifice 128 onto splash plate 130. Fuel mixes with air from air flow path 124 inside lumen 122 before entering central combustor chamber 120. In FIG. 1, air flows from first end 114 to second end before being directed into central combustor chamber 120, where flow direction flips from second end 116 to first end 114.

Figure 2:
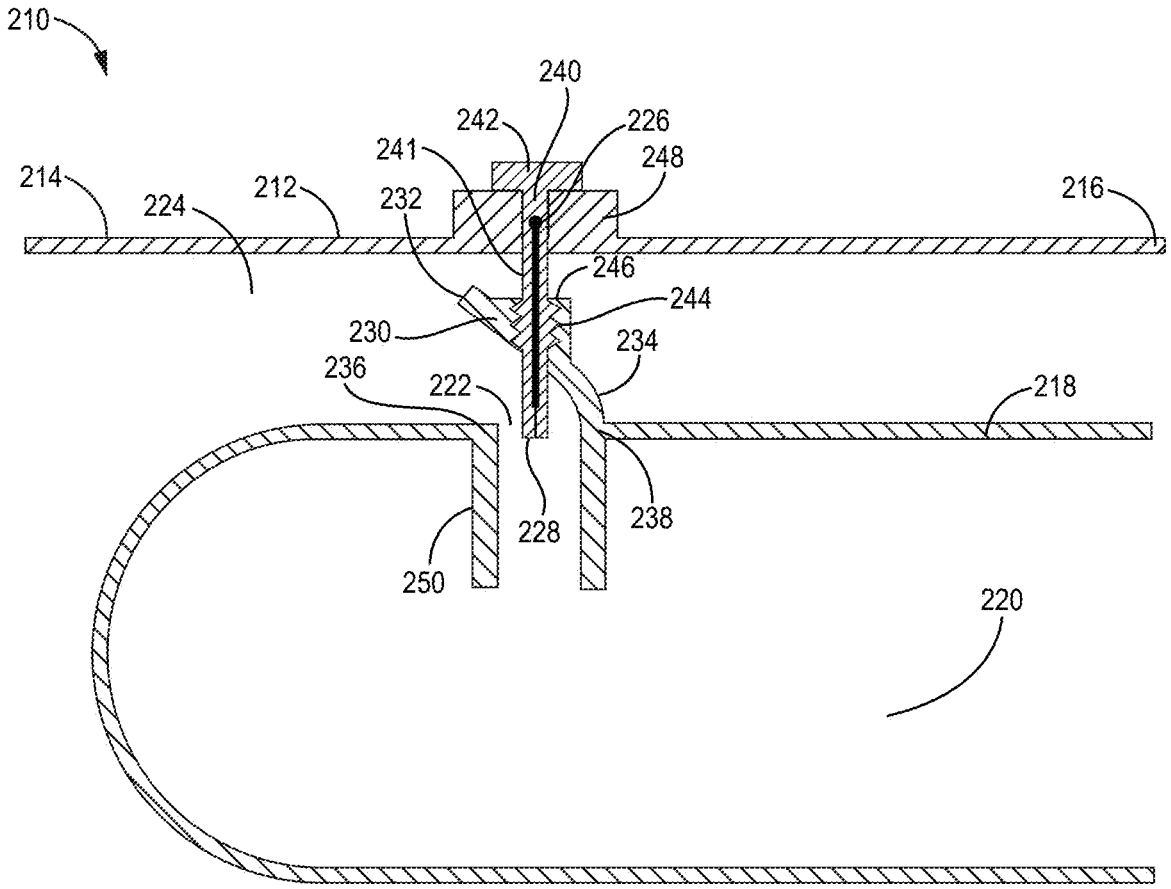
FIG. 2 is an enlarged cross-sectional view of a combustor with a threaded fuel injector bolt with an integrated air scoop.

FIG. 2 is an enlarged cross-sectional view of a combustor with a threaded fuel injector bolt with an integrated air scoop. FIG. 2 shows gas turbine engine assembly 210. Assembly 210 includes outer liner 212 with first end 214 and second end 216, inner combustor case 218 defining central combustor chamber 220 with lumen 222, first air flow path 224, fuel manifold 226, and fuel orifice 228. Assembly 210 further includes integrated air scoop 230 with first end 232 and second end 234. Lumen 222 further includes first lip 236 and second lip 238. Assembly 210 further includes fuel bolt 240 which includes head 242 and threads 244. Integrated air scoop 230 includes scoop boss 246. Outer liner 212 includes bolt reinforcement 248. Inner combustor case 218 includes chute 250.

Air flow enters at first end 214 before flowing towards second end 216. Air flow can be a standard air mixture or have higher oxygen content. Inner combustor case 218 defines central combustor chamber 220, with lumen 222 linking central combustor chamber 220 and air flow path 224. Fuel from fuel manifold 226 is directed into lumen 220 by fuel orifice 228. Integrated air scoop 230 directs air flow from air flow path 224 through lumen 222 into central combustor chamber 220. Due to fluid dynamics, as airflow enters first end 214, fluid flow will concentrate towards outer liner 212. Scoop 230 overcomes these fluidic forces to direct more airflow into central combustor chamber 220. Scoop 230 can be attached to inner combustor case 218 at second lip 238. Fuel bolt 240 includes fuel bolt body 241 and head 242 outside of outer liner 212. Fuel manifold 226 is contained within fuel bolt 240, between head 242 and outer liner 212, and is surrounded by bolt reinforcement 248. Fuel runs along the length of fuel bolt body 241 before exiting from fuel orifice 228. Threads 244 can attach fuel bolt 240 to integrated air scoop 230 at scoop boss 246. Fuel that enters lumen 222 is directed into combustor chamber 220 via chute 250.

The configurations disclosed above allow inner combustor case 218 to slide from second end 216 of outer liner 212 to first end 214, while still providing improved air flow into central combustor chamber 220. Fuel bolts align outer liner 212 and inner combustor case 218. Fuel bolts 240 allow the fuel from fuel manifold 226 to be located further from central combustor chamber 220 to avoid excessive heating of the fuel as the fuel travels from fuel manifold 226 out of fuel orifice 228. This can reduce fouling within the component, extending life. Bolt reinforcement 248 increases structural integrity of fuel bolt 240 by reinforcing the bolt from any shear, and also further insulates fuel manifold 226 from high temperatures. Scoop boss 246 attaches to threads 244 of fuel bolt 240, and scoop boss 246 further insulates fuel from high temperatures and decreases the likelihood of detachment between outer liner 212 and inner combustor case 218. Fuel bolts 240 mechanically connect outer liner 212 to the inner combustor case 218. Fuel bolts 240 allow the combustor to grow as thermal effects expand the geometry, and also act as an alignment aid to center inner combustor case 218 within outer liner 212. Threads 244 ensure that fuel bolts 240 stay within scoop boss 246. In these embodiments, the assembly as discussed above may be spaced circumferentially around an axis, with a plurality of scoops, lumens, and fuel bolts around a central combustor chamber. Not all fuel bolts and scoop bosses need to be threaded. This configuration mitigates the need for fastening/centering features for the combustor. Additive costs can be minimized and this will positively influence assembly processes.

A small combustor is required to fit between different engine components, such as a centrifugal compressor and axial turbine (not pictured). The structures presented here reduce air pressure losses, improve fuel/air mixing, and feed the combustor with bulk swirl for improved combustion efficiency with lower smoke. Additionally, this design allows additively manufactured components that have tighter clearances, resulting in higher efficiency.

In other embodiments, assembly may include a splash plate, including a lattice splash plate, to further facilitate air/fuel mixing. In other embodiments integrated air scoop can be a canted scoop.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

One embodiment of a combustor system for an aerial vehicle includes an outer liner with a first end and a second end, an inner combustor case contained within the outer liner and defining a central combustor chamber, a lumen extending into the central combustor chamber, an air flow path extending between the outer liner and the inner combustor case, an integrated air scoop attached to the inner combustor case at the lumen and directing air from the air flow path into the central combustor chamber, and a fuel bolt, the fuel bolt including a head located outside of the outer liner and a body starting outside of the outer liner and extending perpendicular to the outer liner through the outer liner, through the integrated fuel scoop, and ending at the lumen, and fuel manifold with a fuel orifice within the fuel bolt.

The system of the preceding paragraph can optionally include, additionally and/or alternatively, any one or more of the following features, configurations and/or additional components:

The fuel bolt can include threads along the body of the fuel bolt.

The threads of the fuel bolt can be mechanically attached to a scoop boss within the integrated air scoop.

The combustor system can include a bolt reinforcement section within the outer liner, wherein the fuel manifold of the fuel bolt is surrounded by the bolt reinforcement section.

The integrated air scoop can be canted and further include a first end of the integrated air scoop connected to the inner combustor case on a first lip of the first lumen and a second end of the integrated air scoop connected to the inner combustor case on a second lip of the first lumen.

The fuel orifice can be configured to direct fuel perpendicular to the inner combustor case.

The fuel orifice can be located flush with an inner face of the integrated air scoop.

The body of the fuel bolt can extend through the first lumen.

9. The fuel chutes can be attached at a first lip of the first lumen and a second lip of the first lumen.

The air flow within the first air flow path can comprise oxygen.

Another embodiment of a combustor system for an aerial vehicle includes an outer liner, the outer liner having a first end and a second end, an inner combustor case contained within the outer liner, the inner combustor case defining an outer periphery of a central combustor chamber, the inner combustor case having a plurality of lumens extending through the inner combustor case into the central combustor chamber, a first air flow path extending between and defined by the outer liner and the inner combustor case, and fluidly connected to the central combustor chamber by the plurality of lumens, a plurality of integrated air scoops, each respective integrated air scoop attached to the inner combustor case at each respective lumen and configured to direct air from the first air flow path into the central combustor chamber, a plurality of fuel bolts, the plurality of fuel bolts including a plurality of heads located outside of the outer liner and a plurality of bodies starting outside of the outer liner and extending perpendicular to the outer liner through the outer liner, through the plurality of integrated fuel scoops, and ending at the plurality of lumens, and a plurality of fuel manifolds with a plurality of fuel orifices within each respective fuel bolt.

The assembly of the preceding paragraph can optionally include, additionally and/or alternatively, any one or more of the following features, configurations and/or additional components:

At least one fuel bolt further can include threads along the body of the respective fuel bolt.

The threads of the at least one fuel bolt can be mechanically attached to a scoop boss within the respective integrated air scoop.

The combustor system can further include a plurality of bolt reinforcement sections within the outer liner, wherein the respective fuel manifold of the plurality of fuel bolts is surrounded by the respective bolt reinforcement section.

At least one integrated air scoop can be canted and further include a first end of the respective integrated air scoop connected to the inner combustor case on a first lip of the respective lumen and a second end of the respective integrated air scoop connected to the inner combustor case on a second lip of the respective lumen.

Multiple fuel chutes can be attached at a first lip of the plurality of lumens and a second lip of the plurality of lumens.

An example method of forming an assembly for a gas turbine engine including forming an annular outer liner, the annular outer liner having a central axis, forming an annular inner case concentric with and radially inward of the annular outer liner, forming a fuel bolt, the fuel bolt comprising a head, a body, a threaded portion, and a fuel manifold with a fuel orifice extending radially along the body of the fuel bolt, forming an air scoop connected to the annular inner case, the air scoop comprising a scoop boss with threads, forming a radially extending bore through the annular outer liner, the air scoop, and the inner casing, and positioning the fuel bolt through the radially extending bore and securing the fuel bolt to the air scoop via the threads of the fuel bolt and the threads of the scoop boss.

The method of the preceding paragraph can optionally include, additionally and/or alternatively, any one or more of the following features, configurations and/or additional components:

Forming the annular outer liner further can further include forming a bolt reinforcement region.

The fuel bolt can be perpendicular to the annular outer liner and the annular inner case.

The threads of the fuel bolt can be equally spaced from the annular outer liner and the annular inner case when positioned.

The invention claimed is:

1. A combustor system for an aerial vehicle, the combustor system comprising:

an outer liner, the outer liner having a first end and a second end;

an inner combustor case contained within the outer liner, the inner combustor case defining an outer periphery of a central combustor chamber, the inner combustor case having a lumen extending into the central combustor chamber;

a first an air flow path extending between and defined by the outer liner and the inner combustor case;

an integrated air scoop configured to direct air from the air flow path into the central combustor chamber via the lumen, the integrated air scoop comprising;

a first end of the integrated air scoop connected to the inner combustor case on a first lip of the lumen;

a second end of the integrated air scoop spaced radially outward from the inner combustor case and from a second lip of the lumen; and a scoop boss defined on the integrated air scoop between the first end of the integrated air scoop and the second end of the integrated air scoop, the scoop boss spaced from the outer liner and from the inner combustor case, and wherein the second end of the integrated air scoop extends towards the outer liner into the air flow path beyond the scoop boss;

a fuel bolt, the fuel bolt comprising:

a head located outside of the outer liner;

a body starting outside of the outer liner and extending perpendicular to the outer liner, the body extending through the outer liner, through the scoop boss, through the integrated air scoop, and ending at the first lumen; and a fuel manifold with a fuel orifice within the fuel bolt.

2. The combustor system of claim 1, wherein the fuel bolt further comprises threads along the body of the fuel bolt.

3. The combustor system of claim 2, wherein the threads of the fuel bolt are mechanically attached to the scoop boss within the integrated air scoop.

4. The combustor of claim 1, further comprising:

a bolt reinforcement section within the outer liner, wherein the fuel manifold of the fuel bolt is surrounded by the bolt reinforcement section.

5. The combustor system of claim 4, wherein the integrated air scoop is canted.

6. The combustor system of claim 1, wherein the fuel orifice is configured to direct fuel perpendicular to the inner combustor case.

7. The combustor system of claim 1, wherein the body of the fuel bolt extends through the lumen.

8. The combustor system of claim 1, wherein a fuel chute extending into the central combustor chamber is attached at the first lip of the lumen and the second lip of the lumen.

9. The combustor system of claim 1, wherein the air flow within the air flow path comprises oxygen.

10. A combustor system for an aerial vehicle, the combustor system comprising:

an outer liner, the outer liner having a first end and a second end;

an inner combustor case contained within the outer liner, the inner combustor case defining an outer periphery of a central combustor chamber, the inner combustor case having a plurality of lumens extending through the inner combustor case into the central combustor chamber, each lumen having a first lip and a second lip;

an air flow path extending between and defined by the outer liner and the inner combustor case, and fluidly connected to the central combustor chamber by the plurality of lumens;

a plurality of integrated air scoops, each integrated air scoop configured to direct air from the first air flow path into the central combustor chamber through a respective lumen, each integrated air scoop further comprising;

a first end of the integrated air scoop connected to the inner combustor case on a respective first lip of the respective lumen;

a second end of the integrated air scoop spaced radially outward from the inner combustor case and a respective second lip of the respective lumen; and a scoop boss defined on the integrated air scoop between the first end of the integrated air scoop and the second end of the integrated air scoop, the scoop boss spaced from the outer liner and from the inner combustor case, and wherein the second end of the integrated air scoop extends towards the outer liner into the air flow path beyond the scoop boss;

a plurality of fuel bolts, each fuel bolt comprising:

a head located outside of the outer liner;

a body starting outside of the outer liner and extending perpendicular to the outer liner, the body extending through the outer liner, through a respective scoop boss, through a respective integrated air scoop, and ending at the respective lumen; and a fuel manifold with a fuel orifice within the fuel bolt.

11. The combustor system of claim 10, wherein at least one fuel bolt of the plurality of fuel bolts further comprises threads along a respective body of the at least one fuel bolt.

12. The combustor system of claim 11, wherein the threads of the at least one fuel bolt are mechanically attached to the respective scoop boss on the respective integrated air scoop.

13. The combustor system of claim 10, further comprising:

a plurality of bolt reinforcement sections within the outer liner, wherein a respective fuel manifold of each of the plurality of fuel bolts is surrounded by a respective bolt reinforcement section.

14. The combustor system of claim 13, at least one of the plurality of integrated air scoops is canted.

15. The combustor system of claim 10, comprising a plurality of fuel chutes extending into the central combustor chamber, wherein each fuel chute is attached at a respective lumen at the respective first lip and the respective second lip of the respective lumen of the plurality of lumens.

16. A method of forming an assembly for a gas turbine engine, the method comprising:

forming an annular outer liner, the annular outer liner having a central axis;

forming an annular inner case concentric with and radially inward of the annular outer liner, the annular inner case defining an outer periphery of a central combustor chamber and the annular inner case having a lumen extending into the central combustor chamber;

forming a fuel bolt, the fuel bolt comprising a head, a body including a threaded portion, and a fuel manifold with a fuel orifice extending radially along the body of the fuel bolt;

forming an air scoop connected to the annular inner case, the air scoop comprising a scoop boss, wherein a first end of the air scoop is connected to the annular inner case on a first lip of the lumen in the annular inner case, and a second end of the air scoop is spaced radially outward from the annular inner case and from a second lip of the lumen, wherein the second end of the air scoop extends towards the annular outer liner into an air flow path extending between and defined by the annular outer liner and the annular inner case, the air scoop configured to direct air from the air flow path into the central combustor chamber via the lumen, wherein the scoop boss is defined on the air scoop between the first end of the air scoop and the second end of the air scoop, the scoop boss spaced from the annular outer liner and from the annular inner case, the second end of the air scoop extending into the air flow path beyond the scoop boss;

forming a radially extending bore through the annular outer liner, the scoop boss, and the air scoop, the scoop boss further comprising threads; and positioning the fuel bolt through the radially extending bore with the head outside the annular outer liner and securing the fuel bolt to the air scoop via the threaded portion of the fuel bolt and the threads of the scoop boss, the fuel bolt ending at the lumen.

17. The method of claim 16, wherein forming the annular outer liner further comprises forming a bolt reinforcement region.

18. The method of claim 16, wherein the fuel bolt is perpendicular to the annular outer liner and the annular inner case.

* * * * *